US011540594B2

(12) United States Patent
Case et al.

(10) Patent No.: US 11,540,594 B2
(45) Date of Patent: Jan. 3, 2023

(54) FOOTWEAR BLADDER SYSTEM

(71) Applicant: NIKE, Inc., Beaverton, OR (US)

(72) Inventors: Patrick Case, Portland, OR (US); Zachary M. Elder, Portland, OR (US); Dervin A. James, Hillsboro, OR (US); Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/494,375

(22) Filed: Oct. 5, 2021

(65) Prior Publication Data

US 2022/0022598 A1 Jan. 27, 2022

Related U.S. Application Data

(63) Continuation of application No. 16/671,835, filed on Nov. 1, 2019, now Pat. No. 11,166,524.

(Continued)

(51) Int. Cl.
*A43B 13/20* (2006.01)
*A43B 13/02* (2022.01)

(Continued)

(52) U.S. Cl.
CPC ..... *A43B 13/206* (2013.01); *A43B 13/20* (2013.01); *A43B 13/203* (2013.01); *A43B 13/023* (2013.01);

(Continued)

(58) Field of Classification Search
CPC ..... A43B 13/023; A43B 13/04; A43B 13/12; A43B 13/125; A43B 13/127; A43B 13/14;

(Continued)

(56) References Cited

U.S. PATENT DOCUMENTS 5,575,088 A * 11/1996 Allen ..... A43B 1/0072 36/153
5,933,983 A * 8/1999 Jeon ..... A43B 21/28 36/35 B (Continued)

FOREIGN PATENT DOCUMENTS

CN 1133149 A 10/1996
KR 100741628 B1 7/2007

*Primary Examiner* — Jameson D Collier
*Assistant Examiner* — Matthew R Marchewka
(74) *Attorney, Agent, or Firm* — Quinn IP Law

(57) ABSTRACT

A sole structure for an article of footwear includes a bladder system with a first bladder enclosing a first sealed chamber retaining fluid, and a second bladder overlying and bonded to the first bladder and enclosing a second sealed chamber isolated from the first sealed chamber and retaining fluid. The first bladder establishes a ground-facing surface and the second bladder establishes a foot-facing surface of the bladder system. The first bladder includes first domed pods extending at the ground-facing surface and at an upper surface of the first bladder, the first sealed chamber filling the first domed pods. The second bladder includes second domed pods and annular ring pods, the second domed pods and the annular ring pods extending at the lower surface of the second bladder and at the foot-facing surface, the second sealed chamber filling the second domed pods and the annular ring pods.

19 Claims, 6 Drawing Sheets

Related U.S. Application Data

(60) Provisional application No. 62/769,831, filed on Nov. 20, 2018.

(51) Int. Cl.
*A43B 13/04* (2006.01)
*A43B 13/12* (2006.01)
*A43B 13/18* (2006.01)

(52) U.S. Cl.
CPC ..... *A43B 13/04* (2013.01); *A43B 13/12* (2013.01); *A43B 13/189* (2013.01)

(58) Field of Classification Search
CPC ..... A43B 13/16; A43B 13/18; A43B 13/185; A43B 13/189; A43B 13/20; A43B 13/203; A43B 13/206; A43B 17/03; A43B 17/035; A43B 21/28; A43B 21/285
USPC ..... 36/28, 29, 35 B, 153
See application file for complete search history.

(56) References Cited

U.S. PATENT DOCUMENTS 6,029,962 A * 2/2000 Shorten ..... B29C 51/267 267/145
6,931,764 B2 * 8/2005 Swigart ..... A43B 13/20 36/35 B
7,685,743 B2 * 3/2010 Swigart ..... A43B 13/181 36/35 R
7,784,196 B1 * 8/2010 Christensen ..... A43B 13/26 36/29
2004/0003517 A1 1/2004 Marvin et al.
2004/0010853 A1 * 1/2004 Muci ..... A47C 27/081 5/644
2012/0167413 A1 7/2012 Marvin et al.
2013/0000147 A1 * 1/2013 Goodwin ..... A43B 13/206 36/84
2013/0125421 A1 5/2013 Stegmaier et al.
2013/0212909 A1 * 8/2013 Bates ..... A43B 13/203 36/102
2015/0033577 A1 * 2/2015 Dahl ..... A43B 13/20 12/146 B
2016/0295968 A1 * 10/2016 Campos, II ..... A43B 13/20
2020/0359737 A1 * 11/2020 Sung ..... A43B 13/145

* cited by examiner

FOOTWEAR BLADDER SYSTEM

CROSS-REFERENCE TO RELATED APPLICATION

This application claims is a continuation of U.S. patent application Ser. No. 16/671,835, filed Nov. 1, 2019, which claims the benefit of priority to U.S. Provisional Application No. 62/769,831, filed Nov. 20, 2018, and both of which are hereby incorporated by reference in their entirety.

TECHNICAL FIELD

The present disclosure generally relates to a midsole for an article of footwear, and more specifically to a midsole with a bladder system.

BACKGROUND

An article of footwear typically includes a sole structure configured to be located under a wearer's foot to space the foot away from the ground. Sole structures in athletic footwear are typically configured to provide cushioning, motion control, and/or resilience.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
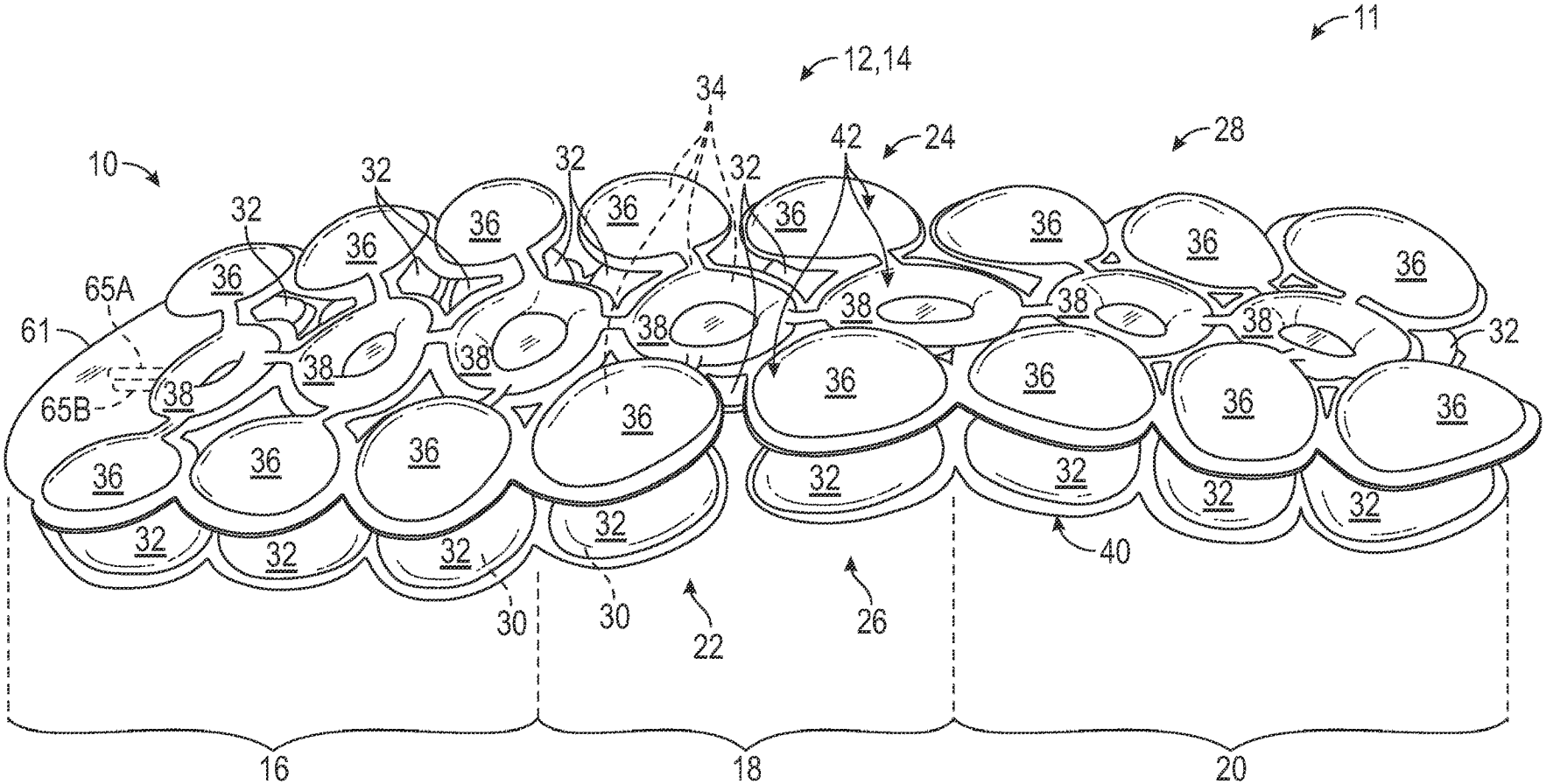
FIG. 1 is a top perspective view of a bladder system for an article of footwear.

The present disclosure generally relates to a midsole for an article of footwear, and more specifically to a bladder system providing two isolated, fluid-filled chambers serving as a first and a second cushioning layer. The bladder system may comprise four stacked polymeric sheets. Bladders comprised of stacked sheets are generally easier to assemble and require less dedicated tooling. For example, thermoforming molds are not required. Instead, the geometry of the bladder system results mainly from the placement of anti-weld material between the stacked polymeric sheets before hot-pressing the sheets to one another. The placement of bonds securing the sheets to one another controls the shape and geometry of the bladder system and its fluid chambers, as well as which portions of the fluid chambers are in direct communication with one another, and the cushioning response of various portions of the bladder system.

In an example, a sole structure for an article of footwear comprises a midsole that includes a bladder system. The bladder system may comprise a first bladder enclosing a first sealed chamber retaining fluid as a first cushioning layer, and a second bladder overlying and bonded to the first bladder and enclosing a second sealed chamber. The second sealed chamber may be isolated from the first sealed chamber and retains fluid as a second cushioning layer. The first bladder may establish a ground-facing surface of the bladder system and the second bladder may establish a foot-facing surface of the bladder system.

The first bladder may comprise first domed pods extending at the ground-facing surface and at an upper surface of the first bladder. The first sealed chamber fills the first domed pods. The second bladder may comprise second domed pods and annular ring pods. The second domed pods and the annular ring pods may extend at the lower surface of the second bladder and at the foot-facing surface. The second sealed chamber fills the second domed pods and the annular ring pods.

In one or more implementations, the bladder system may comprise four stacked polymeric sheets. A first sheet may establish the ground-facing surface and include lower portions of the first domed pods. A second sheet may overlie and be bonded to the first sheet to enclose the first sealed chamber. The second sheet may establish the upper surface of the first bladder and include upper portions of the first domed pods. A third sheet may overlie and be bonded to the second sheet. The third sheet may establish the lower surface of the second bladder and include lower portions of the second domed pods and lower portions of the annular ring pods. A fourth sheet may overlie and be bonded to the third sheet to enclose the second sealed chamber, and establish the foot-facing surface. The fourth sheet may include upper portions of the second domed pods and upper portions of the annular ring pods.

Spaces between the exterior surfaces of the stacked sheets (e.g., the surfaces not exposed to the first sealed chamber of the second sealed chamber) may be empty, exposed to ambient air. Additionally, the first bladder may define through holes between at least some adjacent ones of the first domed pods, and the second bladder may define through holes between at least some of the second domed pods and the annular ring pods, preventing the ambient air from being trapped between the sheets.

In one or more configurations, the first sealed chamber fluidly interconnects the first domed pods with one another, and the second sealed chamber fluidly interconnects the annular ring pods with one another and with the second domed pods. Additionally, an internal volume of each of the annular ring pods may be less than an internal volume of each of the second domed pods. The smaller volume may cause the annular ring pods to provide quicker energy return and associated responsive underfoot feel under dynamic loading than the larger volume pods, as maximum displacement is more quickly reached than in the larger volume pods, which may provide a softer underfoot feel. Additionally, because of the fluid communication between domed pods and annular ring pods of the second layer, and fluid communication between domed pods of the first layer, there may be some softening of initial impact of more highly loaded areas under dynamic loading as fluid may be displaced to neighboring pods.

In an aspect, each of the second domed pods may overlie and be bonded to a different one of the first domed pods, establishing stacked domed pod pairs. At least some of the first domed pods may have different internal volumes. However, the stacked domed pod pairs may be configured so that each includes one of the first domed pods and one of the second domed pods having equal internal volumes.

Additionally, each of the annular ring pods may overlie and be bonded to a different one of the first domed pods that is not bonded to any of the second domed pods, establishing stacked annular ring pod/domed pod pairs. These stacked annular ring pod/domed pod pairs may be arranged in a row extending longitudinally along the bladder system. The stacked domed pod pairs may be arranged in a medial row at a medial side of the bladder system, and in a lateral row at a lateral side of the bladder system, with the row of the stacked annular ring pod/domed pod pairs disposed between the medial row of stacked domed pod pairs and the lateral row of stacked domed pod pairs. The more responsive stacked annular ring pod/domed pod pairs will be more centered under the foot, and in a full-length bladder system having forefoot, midfoot, and heel regions, the lower volume annular ring pods may provide a responsive underfoot ride while the larger volume stacked domed pods may provide softer cushioning.

The bladder system may be configured so that the stacked domed pod pairs at least partially establish an outer perimeter of the bladder system. Moreover, at least one of the stacked domed pod pairs may include an off-center bond coupling a domed upper surface of a first domed pod to a domed lower surface of a second domed pod. With an off-center bond, more surface area of the second and third sheets forming the domed pods will be exposed on one side of the off-center bond than on the other side of the off-center bond. If the off-center bond is nearer to an interior side of a stacked domed pod pair than to the outer perimeter of the bladder system, then more surface area of the connected domed pods will be exposed at the outer perimeter than with a centered bond. This will provide more surface area for bonding other components of the footwear to the bladder system at the outer perimeter, if desired, such as a footwear upper.

Additionally, an off-center bond between the two domed pods may cause the inflated domed pods to splay further apart from one another away from the off-center bond in comparison to a domed pod pair having a centered bond connecting the domed surfaces. If the off-center bond is closer to an interior side than to an exterior side of the domed pod pair, then more of the exposed surface area of the domed pod pair at the outer perimeter will face outward. The exterior side of the domed pod pair may also have a greater stacked height than the interior side. In one or more configurations, at least one of the stacked domed pod pairs including the off-center bond may be in the heel region of the bladder system.

The first sealed chamber may be entirely isolated from (e.g., not in fluid communication) with the second fluid chamber due to the separate sheets enclosing the two chambers. The first sheet and the second sheet enclose the first sealed chamber, and the third sheet and the fourth sheet enclose the second sealed chamber. If there is no fluid communication from the second sheet to the third sheet, the first sealed chamber is isolated from the second sealed chamber. The first and the second sealed chambers may be filled with gas at the same or at different inflation pressures to achieve a desired cushioning response. For example, the first sealed chamber closer to the ground may have a lower inflation pressure than the second sealed chamber closer to the foot, the first sealed chamber may have a higher inflation pressure than the second sealed chamber, or the first and second sealed chambers may have the same inflation pressure.

The dynamic response of the bladder system will also be affected by which portions of each of the first and second sealed chambers are in direct communication with one another. With respect to the first sealed chamber, in one or more implementations, each of the first domed pods of the stacked domed pod pairs in the medial row may be directly fluidly connected only to an adjacent one of first domed pods of the stacked annular ring pod/domed pod pairs, each of the first domed pods of the stacked domed pod pairs in the lateral row may be directly fluidly connected only to an adjacent one of first domed pods of the stacked annular ring pod/domed pod pairs, and each of the first domed pods of the stacked annular ring pod/domed pod pairs may be directly fluidly connected to an adjacent one of the first domed pods of the stacked annular ring pod/domed pod pairs. A rearmost one of the first domed pods of the stacked annular ring pod/domed pod pairs may be directly fluidly connected to two of the first domed pods of the stacked domed pod pairs in the lateral row and to two of the first domed pods of the stacked domed pod pairs in the medial row. Moreover, in some configurations, none of the first domed pods of the stacked domed pod pairs in the medial row are directly fluidly connected to one another, and none of the first domed pods of the stacked domed pod pairs in the lateral row are directly fluidly connected to one another.

Similarly, with respect to the second sealed chamber, each of the second domed pods of the stacked domed pod pairs in the medial row may be directly fluidly connected only to an adjacent one of annular ring pods of the stacked annular ring pod/domed pod pairs, each of the second domed pods of the stacked domed pod pairs in the lateral row may be directly fluidly connected only to an adjacent one of annular ring pods of the stacked annular ring pod/domed pod pairs, and each of the annular ring pods of the stacked annular ring pod/domed pod pairs may be directly fluidly connected to an adjacent one of the annular ring pods of the stacked annular ring pod/domed pod pairs. A rearmost one of the annular ring pods of the stacked annular ring pod/domed pod pairs may be directly fluidly connected to two of the second domed pods of the stacked domed pod pairs in the lateral row and to two of the second domed pods of the stacked domed pod pairs in the medial row. Moreover, in some configurations, none of the second domed pods of the stacked domed pod pairs in the medial row are directly fluidly connected to one another, and none of the second domed pods of the stacked domed pod pairs in the lateral row are directly fluidly connected to one another.

Although adjacent domed pods may not be directly fluidly connected with one another in some embodiments, the sheet material may extend between at least some of the adjacent domed pods to provide a unitary structure. For example, each of the first domed pods of the stacked domed pod pairs in the medial row may include a peripheral flange, some of which are connected to and integral with the peripheral flange of an adjacent one of the first domed pods of the stacked domed pod pairs in the medial row. Similarly, each of the first domed pods of the stacked domed pod pairs in the lateral row may include a peripheral flange, some of which are connected to and integral with the peripheral flange of an adjacent one of the first domed pods of the stacked domed pod pairs in the lateral row. These peripheral flanges between the first domed pods are formed by the first sheet being bonded to the second sheet. Adjacent first domed pods or adjacent second domed pods not connected by a peripheral flange extending between the pods provide increased flexibility at the medial side and/or at the lateral side.

With respect to the second domed pods, the third sheet may be bonded to the fourth sheet to provide connecting material between adjacent second domed pods. More specifically, each of the second domed pods of the stacked domed pod pairs in the medial row may include a peripheral flange, with each peripheral flange connected to and integral with the peripheral flange of an adjacent one of the second domed pods of the stacked domed pod pairs in the medial row. Each of the second domed pods of the stacked domed pod pairs in the lateral row may include a peripheral flange, with each peripheral flange of the second domed pods of the stacked domed pod pairs in the lateral row connected to and integral with the peripheral flange of an adjacent one of the second domed pods of the stacked domed pod pairs in the lateral row.

In an example, a sole structure comprises a midsole including a bladder system comprising four stacked polymeric sheets. The four stacked polymeric sheets may include a first sheet establishing a ground-facing surface of the bladder system, a second sheet overlying and bonded to the first sheet to enclose a first sealed chamber retaining fluid as a first cushioning layer, a third sheet overlying and bonded to the second sheet, and a fourth sheet overlying and bonded to the third sheet to enclose a second sealed chamber. The second sealed chamber may be isolated from the first sealed chamber and may retain fluid as a second cushioning layer. The fourth sheet may establish a foot-facing surface of the bladder system. The first sheet and the second sheet may comprise first domed pods extending at the ground-facing surface of the first sheet and at an upper surface of the second sheet. The first sealed chamber may fill the first domed pods. The third sheet and the fourth sheet may comprise both second domed pods and annular ring pods. The second domed pods may extend downward at the third sheet and may be bonded to the second sheet at a first subset of the first domed pods, establishing stacked domed pod pairs. The second domed pods may extend upward at the foot-facing surface of the fourth sheet. The annular ring pods may extend downward at the third sheet and may be bonded to the second sheet at a second subset of the first domed pods, establishing stacked annular ring pod/domed pod pairs. The annular ring pods may extend upward at the foot-facing surface of the fourth sheet, the second sealed chamber filling the second domed pods and the annular ring pods.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 shows a sole structure 10 for an article of footwear 11. More specifically, a midsole 12 of the sole structure 10 is shown. The midsole 12 includes a bladder system 14. The bladder system 14 shown is referred to as a full-length bladder system as it includes a forefoot region 16, a midfoot region 18, and a heel region 20. The midfoot region 18 is between the heel region 20 and the forefoot region 16. As is understood by those skilled in the art, the forefoot region 16 generally underlies the toes and metatarsal-phalangeal joints of an overlying foot. The midfoot region 18 generally underlies the arch region of the foot. The heel region 20 generally underlies the calcaneus bone. The bladder system 14 has a medial side 22 generally shaped to follow the medial side of an overlying foot, and a lateral side 24 generally shaped to follow the lateral side of an overlying foot.

The bladder system 14 includes a first bladder 26 and a second bladder 28. The first bladder 26 encloses a first sealed chamber 30. The first sealed chamber 30 retains fluid, such as gas, that acts as a first cushioning layer. As further discussed herein, the first bladder 26 includes many domed pods 32, referred to as first domed pods, and the first sealed chamber 30 extends in and all of the first domed pods without being subdivided into sealed sub-chambers. The first sealed chamber 30 is labelled in only some of the first domed pods 32 in FIG. 1.

The second bladder 28 overlies and is bonded to the first bladder 26, and encloses a second sealed chamber 34. The second sealed chamber 34 is isolated from the first sealed chamber 30 and retains fluid, such as gas, that acts as a second cushioning layer. As further discussed herein, the second bladder 28 includes many domed pods 36, referred to as second domed pods, as well as many annular ring pods 38. Only some of the second domed pods 36 and annular ring pods 38 are labelled in FIG. 1. The second sealed chamber 34 extends in all of the second domed pods 36 and in all of the annular ring pods 38 without being subdivided into sealed sub-chambers. The second sealed chamber 34 is labelled in only some of the second domed pods 36 and annular ring pods 38 in FIG. 1.

The first bladder 26 establishes a ground-facing surface 40 of the bladder system 14 and the second bladder 28 establishes a foot-facing surface 42 of the bladder system 14. The first bladder 26 may be referred to as a lower bladder, and the second bladder 28 may be referred to as an upper bladder. Other components may be used in conjunction with the bladder system 14 to complete the midsole 12 and the sole structure 10. For example, in some embodiments, other components of the sole structure 10 may be secured to the bladder system 14. For example, an outsole or outsole components may be secured at the ground-facing surface 40, or a foam midsole layer may be secured at the ground-facing surface 40. Additionally or as an alternative, a foam midsole layer may be secured at the foot-facing surface 42. For example, different foam midsole layers may be secured at both the foot-facing surface 42 and the ground-facing surface 40. Additionally, a footwear upper may be secured to the bladder system 14 at the foot-facing surface 42 and/or at side surfaces at the outer perimeter of the bladder system 14.

Figure 2:
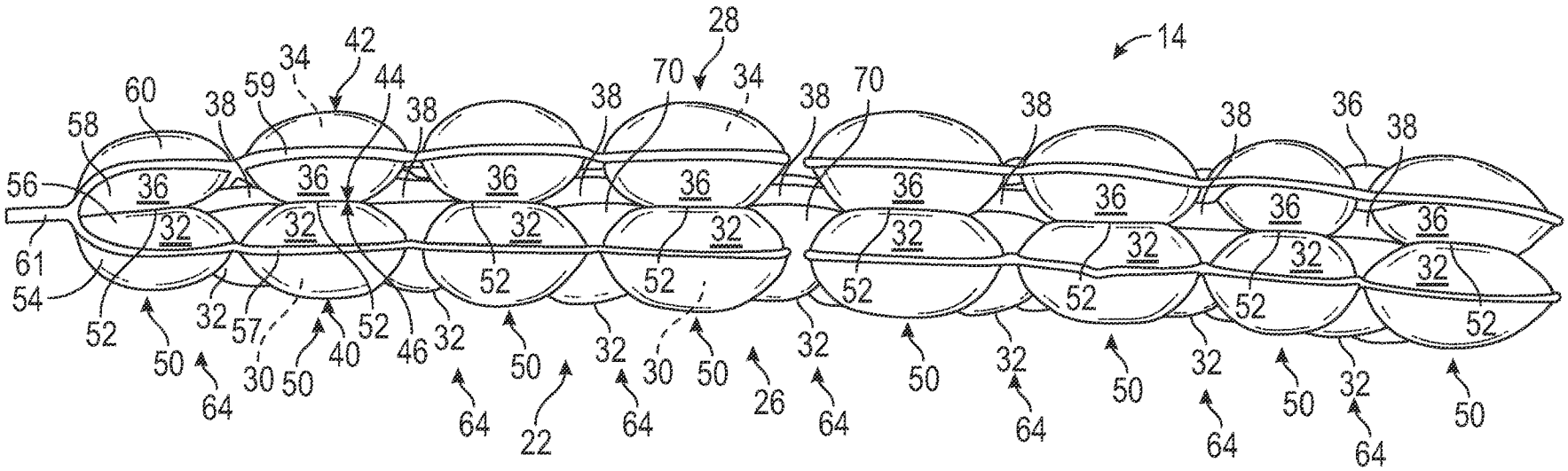
FIG. 2 is a medial side view of the bladder system of FIG. 1.

FIG. 2 shows the first domed pods 32 extending at and establishing the ground-facing surface 40. The first domed pods 32 also extend at an upper surface 44 of the first bladder 26. The first sealed chamber 30 fills the first domed pods 32. The second bladder 28 includes the second domed pods 36 and the annular ring pods 38. The annular ring pods 38 are only partially visible in the medial side view of FIG. 2, through openings between the first domed pods 32 and the second domed pods 36. The second domed pods 36 and the annular ring pods 38 extend at a lower surface 46 of the second bladder 28 and also extend at the foot-facing surface 42. The second sealed chamber 34 fills the second domed pods 36 and the annular ring pods 38.

As shown in FIG. 2, the second domed pods 36 each overlie and are bonded to a different one of the first domed pods 32. Although not apparent in FIG. 2, the second domed pods 36 at the lateral side 24 also overlie and are bonded to different ones of the first domed pods 32. Stated differently, each second domed pod 36 and the first domed pod 32 to which it is bonded establishes stacked domed pod pairs 50. There is a total of eight stacked domed pod pairs 50 arranged in a longitudinally-extending row at the medial side 22 of the bladder system 14. This row of eight stacked domed pod pairs 50 is referred to as a medial row of stacked domed pod pairs 50. The bond 52 between the first domed pod 32 and the second domed pod 36 of each stacked domed pod pair 50 is a bond of the upper surface 44 of the first bladder 26 at the first domed pod 32 to the lower surface 46 of the second bladder 28 at the second domed pod 36.

As further discussed herein, the position of each such bond relative to the center axes of the first domed pod 32 and the second domed pod 36 in a stacked domed pod pair 50 can affect the orientation and splay of the first domed pod 32 and the second domed pod 36. The first domed pod 32 and the second domed pod 36 of each stacked domed pod pair 50 will absorb a dynamic load in series, as they are stacked vertically between the ground and an overlying foot. Additionally, different stacked domed pod pairs 50 in the same vicinity absorb a dynamic load in parallel with one another, and in parallel with stacked annular ring pod/domed pod pairs further discussed herein.

As is evident in both FIGS. 1 and 2, the first domed pods 32 are not all of the same shape or size as one another, and the second domed pods 36 are not all of the same shape or size as one another. Accordingly, at least some of the first domed pods 32 have different internal volumes, and at least some of the second domed pods 36 have different internal volumes. The different shapes and internal volumes of the first domed pods 32 and the second domed pods 36 affect the cushioning and energy return provided during dynamic loading to the portions of the foot that they underlie. For example, in some embodiments, the internal volumes of the first domed pods 32 and second domed pods 36 at the midfoot region 18 may be larger than those in the forefoot region 16 and/or those in the heel region 20. In the embodiment of the bladder system 14 shown and described herein, in each stacked domed pod pair 50, the first domed pod 32 and the second domed pod 36 are of the same size and shape, and have an equal internal volume when inflated and sealed. In other embodiments, some or all of the stacked domed pod pairs 50 may have a first domed pod 32 and a second domed pod 36 of different size, shape, and/or internal volume.

The bladder system 14 includes four stacked polymeric sheets 54, 56, 58, and 60. A first sheet 54 establishes the ground-facing surface 40 and includes lower portions of the first domed pods 32. A second sheet 56 overlies and is bonded to the first sheet 54 at a peripheral flange 57 to enclose the first sealed chamber 30. The peripheral flange 57 extends around each of the first domed pods 32. The second sheet 56 establishes the upper surface 44 of the first bladder 26, and includes upper portions of the first domed pods 32. Accordingly, the first bladder 26 is a two sheet bladder, including the first sheet 54, and the second sheet 56.

A third sheet 58 overlies and is bonded to the second sheet 56 at the bonds 52. The third sheet 58 establishes the lower surface 46 of the second bladder 28, and includes lower portions of the second domed pods 36 and lower portions of the annular ring pods 38. A fourth sheet 60 overlies and is bonded to the third sheet 58 at a peripheral flange 59 to enclose the second sealed chamber 34, and to establish the foot-facing surface 42. The peripheral flange 59 extends around each of the second domed pods 36, and is separate from and not bonded to the peripheral flange 57 except at the forwardmost flange 61 at which the peripheral flanges 57, 59 merge. The fourth sheet 60 includes upper portions of the second domed pods 36 and upper portions of the annular ring pods 38. Accordingly, the second bladder 28 is a two sheet bladder, including the third sheet 58, and the fourth sheet 60. Each of the polymeric sheets 54, 56, 58, and 60 extends from the forefoot region 16 to the heel region 20, and from the medial side 22 to the lateral side 24. Stated differently, there are only four polymeric sheets used to construct the bladder system 14, and each sheet extends the width and length of the bladder system 14.

Selection of the shape, size, and location of various bonds such as bonds 52 and bonds at the peripheral flanges 57, 59 provides the desired contoured surfaces of the finished bladder system 14, including the first domed pods 32, the second domed pods 36, and the annular ring pods 38, and also provides fluid communication between different pods within the first bladder 26 and within the second bladder 28. Prior to bonding, the polymeric sheets 54, 56, 58, and 60 are stacked, flat sheets that are coextensive with one another. Anti-weld material is applied to interfacing surfaces of the sheets where bonds are not desired. For example, the anti-weld material may be an ink, referred to as blocker ink, and may be ink-jet printed onto each sheet 54, 56, 58, and 60 according to a programmed pattern that may be different for each sheet 54, 56, 58, and 60 at all selected locations on the sheets where bonds between adjacent sheets are not desired. The stacked, flat polymeric sheets 54, 56, 58, and 60 are then heat pressed to create bonds between adjacent sheets on all adjacent sheet surfaces except for where the anti-weld material was applied. No thermoforming molds or radio frequency welding is necessary. In the completed bladder system 14, areas where the anti-weld material was applied will be disposed either at the internal volumes of the first and second sealed chambers 30, 34, or exterior spaces between the second sheet 56 and the third sheet 58. For example, the anti-weld material will result in the internal volumes of the first domed pods 32, the second domed pods 36 and the annular ring pods 38, as well as various internal channels that interconnect the various first domed pods 32 with one another, interconnect the second domed pods 36 with the annular ring pods 38, or interconnect the annular ring pods 38 with one another, as described herein.

Once bonded, the polymeric sheets 54, 56, 58, and 60 remain flat, and take on the contoured shape of the bladder system 14 only when the chambers 30, 34 are inflated and then sealed. Accordingly, if the inflation gas is removed, and assuming other components are not disposed in any of the sealed chambers 30, 34, and the polymeric sheets are not yet bonded to other components such as an outsole, other midsole layers, or an upper, the polymeric sheets 54, 56, 58, and 60 will return to their initial, flat state.

The polymeric sheets 54, 56, 58, and 60 can be formed from a variety of materials including various polymers that can resiliently retain a fluid such as air or another gas. Examples of polymer materials for the polymeric sheets 54, 56, 58, and 60 include thermoplastic urethane, polyurethane, polyester, polyester polyurethane, and polyether polyurethane. Moreover, the polymeric sheets 54, 56, 58, and 60 can each be formed of layers of different materials. In one embodiment, each polymeric sheet 54, 56, 58, and 60 is formed from thin films having one or more thermoplastic polyurethane layers with one or more barrier layers of a copolymer of ethylene and vinyl alcohol (EVOH) that is impermeable to the pressurized fluid contained therein as disclosed in U.S. Pat. No. 6,082,025, which is incorporated by reference in its entirety. Each polymeric sheet 54, 56, 58, and 60 may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The polymeric sheets 54, 56, 58, and 60 may also each be a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Additional suitable materials for the polymeric sheets 54, 56, 58, and 60 are disclosed in U.S. Pat. Nos. 4,183,156 and 4,219,945 to Rudy which are incorporated by reference in their entireties. Further suitable materials for the polymeric sheets 54, 56, 58, and 60 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the polymeric sheets 54, 56, 58, and 60, engineering properties such as tensile strength, stretch properties, fatigue characteristics, dynamic modulus, and loss tangent can be considered. The thicknesses of polymeric sheets 54, 56, 58, and 60 can be selected to provide these characteristics.

The first sealed chamber 30 is entirely isolated from the fluid (e.g. the gas) in the second sealed chamber 34 due to the separate sheets enclosing the two chambers. Stated differently, there is no opening or other passage allowing fluid to pass from the first sealed chamber 30 through the second sheet 56 and the third sheet 58 and into the second sealed chamber 34. The first and the second sheets 54, 56 completely enclose the first sealed chamber 30, and the third and the fourth sheets 58, 60 completely enclose the second sealed chamber 34. The first and the second sealed chambers 30, 34 may be filled with gas at the same or at different inflation pressures to achieve a desired cushioning response. For example, the first sealed chamber 30 which is closer to the ground may have a lower inflation pressure than the second sealed chamber 34 which is closer to the foot, the first sealed chamber 30 may have a higher inflation pressure than the second sealed chamber 34, or the first and second sealed chambers 30, 34 may have the same inflation pressure. The first sealed chamber 30 retains gas at a first predetermined pressure when the bladder system 14 is in an unloaded state, and the second sealed chamber 34 retains gas at a second predetermined pressure in the unloaded state. The unloaded state is the state of the bladder system 14 when it is not under either steady state loading or dynamic loading. For example, the unloaded state is the state of the bladder system 14 when it is not bearing any loads, such as when it is not worn on a foot. The second predetermined pressure can be different than the first predetermined pressure. The predetermined pressures may be inflation pressures of the gas to which the respective sealed chambers 30, 34 are inflated just prior to finally sealing the chambers 30, 34. The lowest one of the predetermined pressures, such as the first predetermined pressure, may be ambient pressure rather than an inflated pressure, or both chambers may be at ambient pressure. A dynamic compressive load on the bladder system 14 may be due to an impact of the sole structure 10 with the ground, and the corresponding footbed load of a person wearing the article of footwear having the bladder system 14 and an opposite ground load. The dynamic compressive load is absorbed by the first bladder 26 and the second bladder 28 in a sequence according to increasing magnitudes of the stiffness from least stiff to most stiff, with higher inflation pressures associated with greater stiffness. Generally, a smaller volume pod will reach a maximum displacement under a given dynamic load faster than a larger volume pod, providing return energy faster than the larger volume pod. Additionally, a higher pressure pod will reach a maximum displacement faster than a lower pressure pod of the same size. In the bladder system 14, various ones of the pods are interconnected by channels, as described herein. The sizes of the interconnecting channels also influence how quickly gas can be displaced from one pod to the next pod, and therefore influences the stiffness under a dynamic load.

Figure 3:
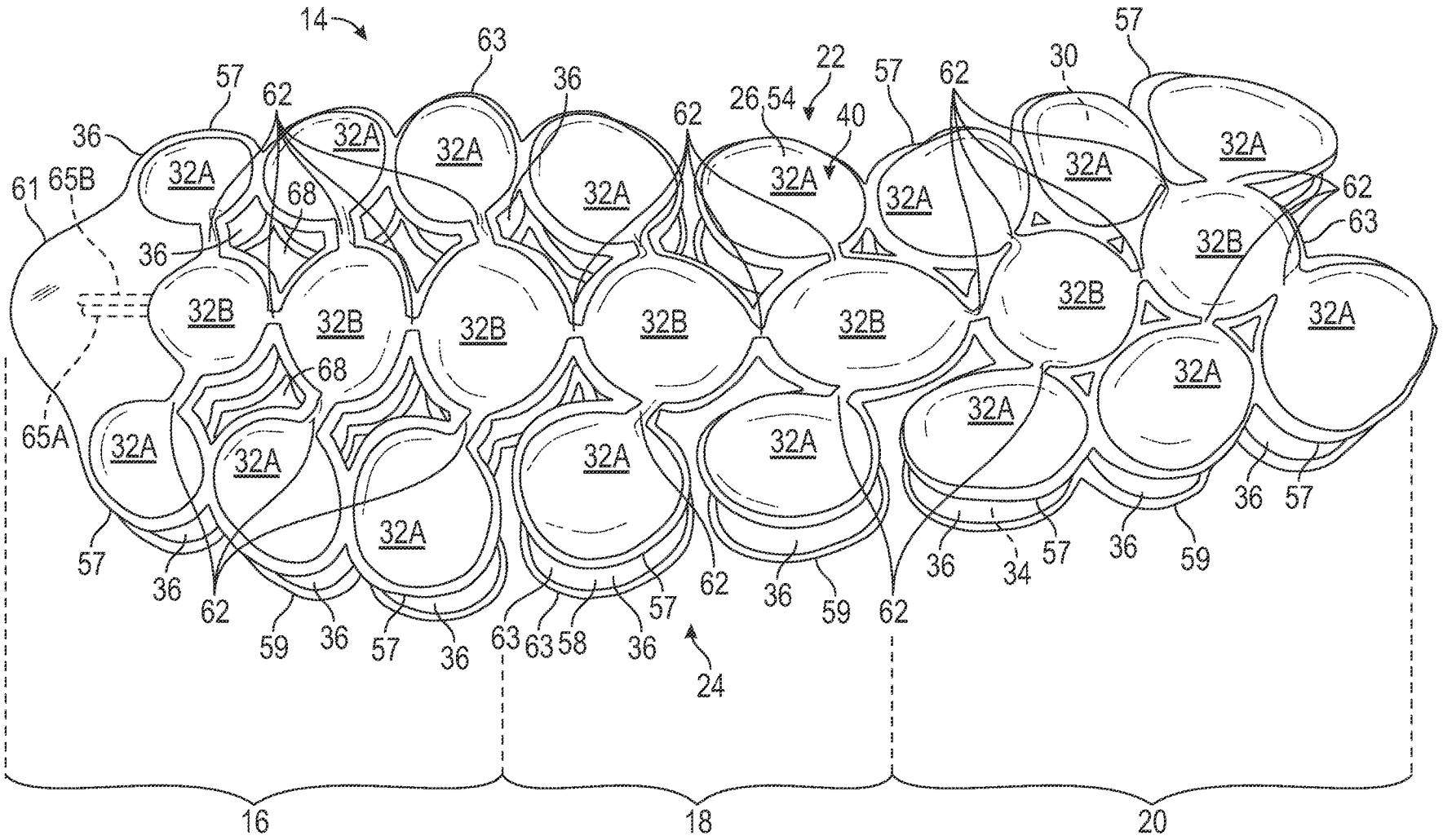
FIG. 3 is a bottom perspective view of the bladder system of FIG. 1.

Referring to FIG. 3, the entire first sealed chamber 30 is distributed in the first domed pods 32 and channels 62 that interconnect the first domed pods 32. The first domed pods 32 may be considered as a first subset 32A and a second subset 32B. The first subset 32A is arranged in a medial row that borders the medial side 22 and in a lateral row that borders the lateral side 24. The medial row and the lateral row establish most of the outer perimeter 63 of the bladder system 14 (e.g., the outer perimeter in the fore-aft and transverse directions of the bladder system 14). A forwardmost flange 61 of the bladder system 14 with plugged inflation tubes 65A, 65B (plugged after inflating the respective first and second sealed chambers 30, 34) and a rearmost pod of the second subset 32B at a gap between the medial and lateral rows establish the remaining portions of the outer perimeter 63.

There are eight first domed pods 32 in the first subset 32A in the medial row, and eight first domed pods 32 in the first subset 32A in the lateral row. The second subset 32B is arranged in a longitudinally-extending row between the medial row and the lateral row of the first subset 32A. There are seven first domed pods 32 in the second subset 32B. As discussed with respect to FIG. 4, the first domed pods 32 of the first subset 32A are included in stacked domed pod pairs 50, and the first domed pods 32 of the second subset 32B are included in stacked annular ring pod/domed pod pairs 64 (only some of which are labelled in FIG. 4). Because the stacked annular ring pod/domed pod pairs 64 are not at the outer perimeter 63 of the bladder system 14 (except for the rearmost one at the gap between the medial and lateral rows), they are best shown in stacked formation in the cross-sectional view of FIG. 5.

The dynamic response of the bladder system 14 will also be affected by which portions of each of the first and second sealed chambers 30, 34 are in direct communication with one another. Although all of the domed pods 32 of the first sealed chamber 30 are in communication with one another, at least indirectly, some of the pods are in direct communication with one another. The same is true of the pods 36, 38 of the second sealed chamber 34. As used herein, pods are directly fluidly connected when they are connected by a channel, such as channel 62, and not indirectly through channels to another pod. With respect to the first sealed chamber 30, as shown by the channels 62, each of the first domed pods 32 of the first subset 32A of the stacked domed pod pairs 50 in the medial row are directly fluidly connected only to an adjacent one of first domed pods 32 of the second subset 32B (e.g., those of the stacked annular ring pod/domed pod pairs 64). Similarly, as indicated by additional channels 62, each of the first domed pods 32 of the first subset 32A of the stacked domed pod pairs 50 in the lateral row are directly fluidly connected only to an adjacent one of first domed pods 32 of the second subset 32B. Each of the first domed pods 32 of the second subset 32B (i.e., those of annular ring pod/domed pod pairs) are directly fluidly connected to an adjacent one of the first domed pods 32 of the second subset 32B. A rearmost one of the first domed pods 32 of the second subset 32B is directly fluidly connected to two of the first domed pods 32 of the first subset 32A in the lateral row and to two of the first domed pods 32 of the first subset 32A in the medial row. The rearmost first domed pod 32 of the second subset 32B thus has five channels 62 directly extending from it, enabling the gas in the first sealed chamber 30 to more quickly displace at the heel region 20 in comparison to the forwardmost first domed pod 32 of the second subset 32B, which has only three channels 62 extending from it.

Moreover, none of the first domed pods 32 of the first subset 32A in the medial row are directly fluidly connected to one another, and none of the first domed pods 32 of the first subset 32A in the lateral row are directly fluidly connected to one another. During a forward foot roll in which dynamic loading begins at the heel region 20 and moves forward, gas in the first sealed chamber 30 is more easily displaced from rear to front from the first domed pods 32 of the second subset 32B than from those of the first subset 32A due to the greater number of channels 62 extending from each of the first domed pods 32 of the second subset 32B.

Although the adjacent domed pods 32 of the first subset 32A in the medial row are not directly fluidly connected with one another, and the adjacent domed pods 32 of the first subset 32A in the lateral row are not directly fluidly connected with one another, the material of the bonded first and second sheets 54, 56 extends between and connects many of the domed pods 32 to provide a unitary structure. The bonded material is trimmed to form the peripheral flange 57, and may be further punched or cut to form through holes 68. Only some of the flanges 57 and through holes 68 are indicated with labels in FIG. 3. For example, each of the first domed pods 32 of the first subset 32A in the medial row include a peripheral flange 57, with each peripheral flange 57 connected to and integral with the peripheral flange 57 of an adjacent one of the first domed pods of the first subset 32A in the medial row except that the fourth and fifth domed pods of the first subset 32A in the middle row are not connected to one another by the peripheral flange 57. Instead, those pods 32 are disconnected at the medial side 22, allowing greater flexibility of the bladder system 14.

Similarly, each of the first domed pods 32 of the first subset 32A in the lateral row include a peripheral flange 57. Some of the adjacent first domed pods of the first subset 32A in the lateral row are connected with one another by the peripheral flange 57. However, the fourth and the fifth domed pods 32 of the first subset 32A of the lateral row are not connected to either adjacent pod 32 by the flange 57. This allows greater flexibility of the bladder system 14, especially with respect to relative rotation about the longitudinal axis of the forefoot region 16 and the heel region 20.

Spaces 70 between the exterior surfaces of the stacked sheets 54, 56, 58, and 60 (e.g., the surfaces not exposed to the first sealed chamber 30 or the second sealed chamber 34) may be empty and exposed to surrounding ambient air. Such spaces are visible in FIGS. 2 and 5, and only some are indicated with reference numerals. Additionally, the through holes 68 in the first bladder 26 between at least some adjacent ones of the first domed pods 32, and similar through holes 69 in the second bladder 28 between at least some of the second domed pods 36 and the annular ring pods 38 (see FIG. 4) prevent the ambient air from being trapped between the second and third sheets 56, 58.

Figure 4:
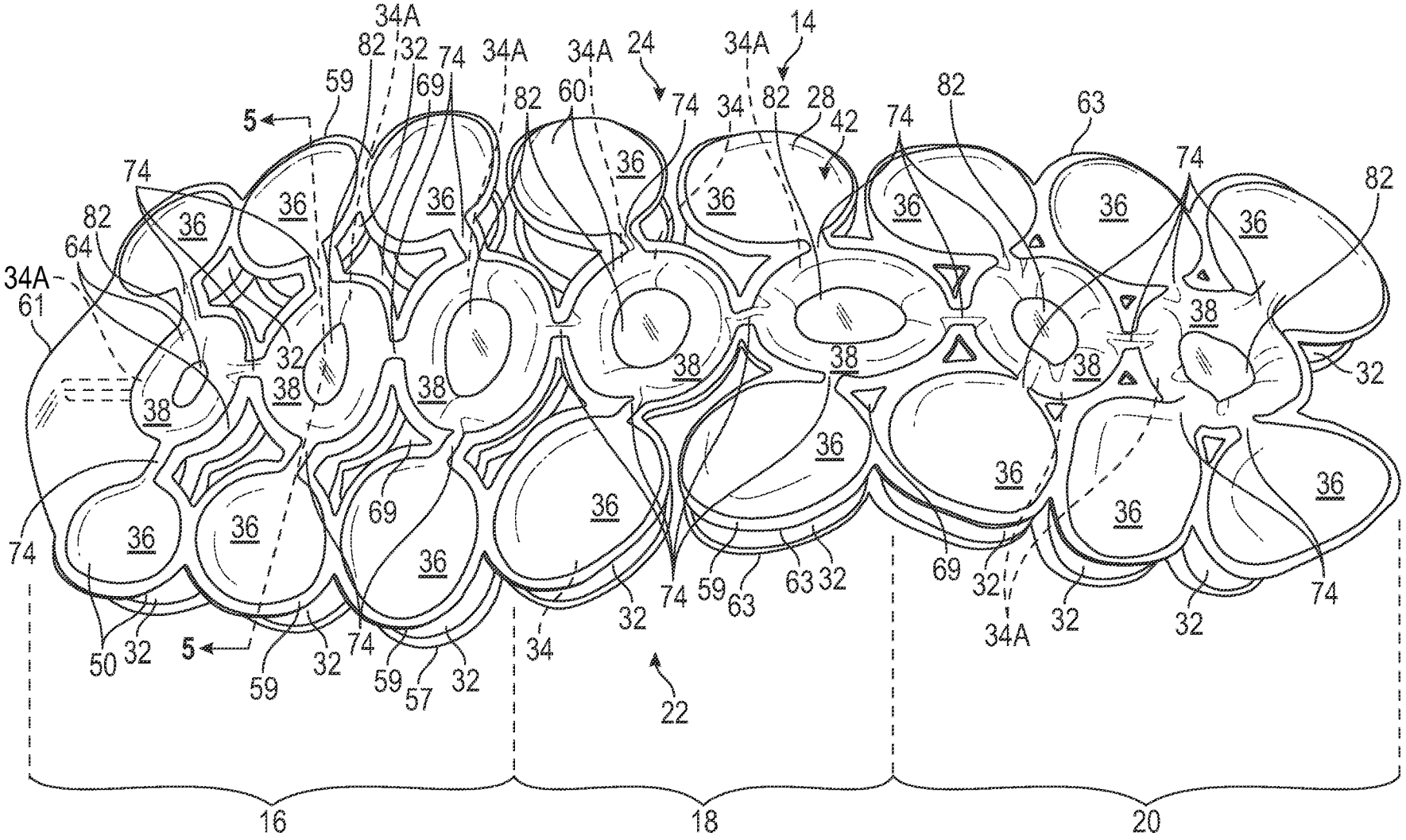
FIG. 4 is another top perspective view of the bladder system of FIG. 1.

Referring to FIG. 4, the second domed pods 36 extend upward at the foot-facing surface 42 of the fourth sheet 60. The annular ring pods 38 also extend upward at the foot-facing surface 42 of the fourth sheet 60. The second sealed chamber 34 fills the second domed pods 36 and the annular ring pods 38.

Figure 5:
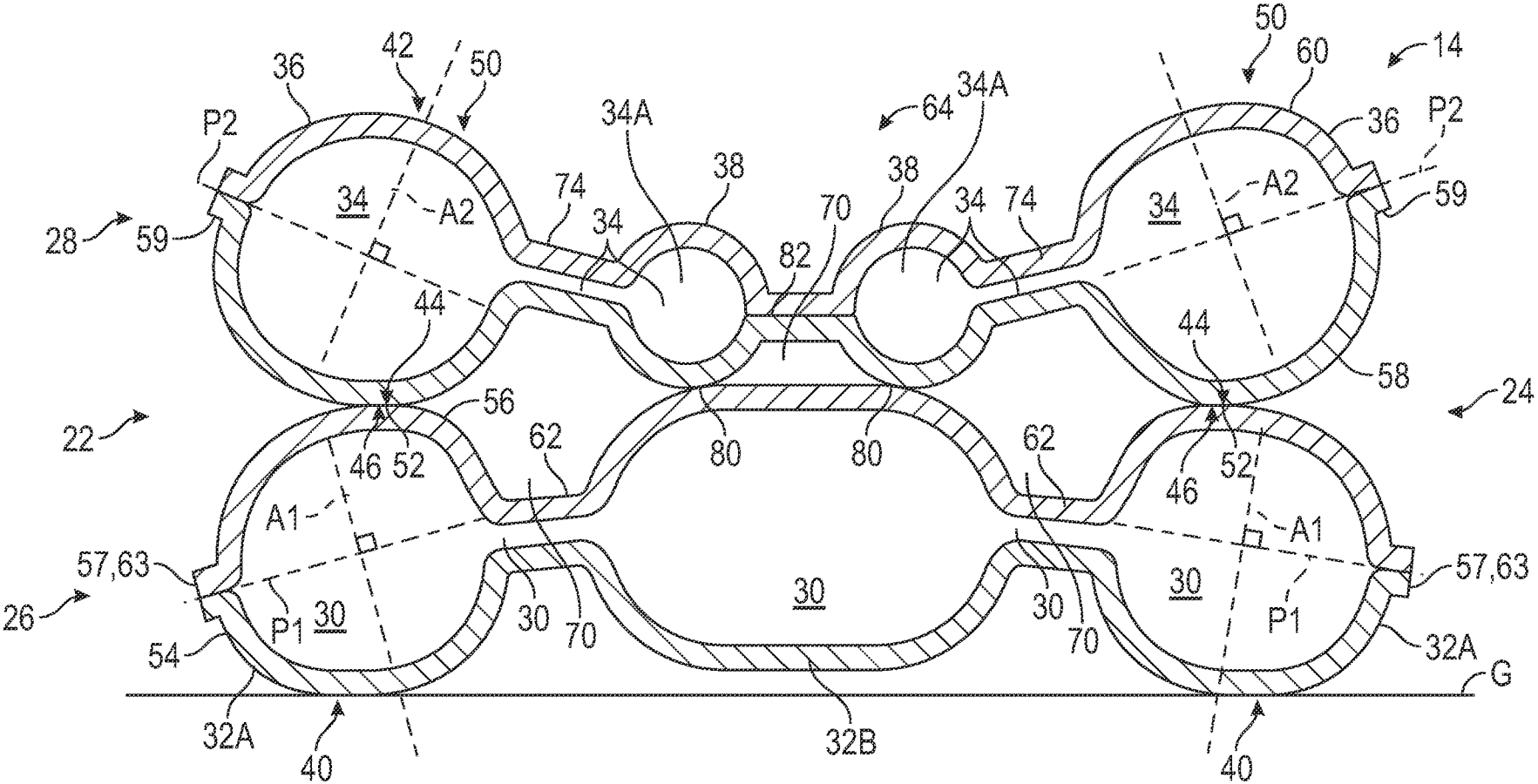
FIG. 5 is a cross-sectional view of the bladder system of FIG. 1 taken at lines 5-5 in FIG. 4.

The second domed pods 36 extend downward at the third sheet 58 as shown in FIG. 2, and are bonded to the second sheet 56 at the first subset 32A of the first domed pods 32, establishing the stacked domed pod pairs 50. The annular ring pods 38 extend downward at the third sheet 58 and are bonded to the second sheet 56 at the second subset 32B of the first domed pods 32, establishing stacked annular ring pod/domed pod pairs 64, shown in FIG. 5. Each of the annular ring pods 38 overlies and is bonded to a different one of the first domed pods 32 of the second subset 32B. As is apparent in FIG. 4, the arrangement and number of the second domed pods 36 at the medial side 22 and at the lateral side 24 matches the arrangement and number of the first subset 32A of first domed pods 32 at the medial side 22 and at the lateral side 24 as described with respect to FIG. 3. Additionally, the annular ring pods 38 match the arrangement and number of the second subset 32B of the first domed pods 32. Accordingly, each of the annular ring pods 38 overlies and is bonded to a different one of the first domed pods 32 that is not bonded to any of the second domed pods 36 (e.g., to a different one of the first domed pods 32 of the second subset 32B), establishing seven stacked annular ring pod/domed pod pairs 64, one of which is shown in FIG. 5. Each stacked annular ring pod/domed pod pair 64 includes an annular ring pod 38 and a first domed pod 32 of the second subset 32B. These stacked annular ring pod/domed pod pairs 64 are arranged in a row extend longitudinally along the bladder system 14 between the medial row of stacked domed pod pairs 50 at the medial side 22 of the bladder system 14, and the lateral row of stacked domed pod pairs 50 at the lateral side 24 of the bladder system 14. The bladder system 14 is thus configured so that the stacked domed pod pairs 50 at least partially establish the outer perimeter 63 of the bladder system 14. The stacked annular ring pod/domed pod pairs 64 will be more centered under the foot than the stacked domed pod pairs 50, and in the full-length bladder system 14, the lower volume annular ring pods 38 will provide a responsive underfoot ride while the larger volume stacked domed pods 36 to which they are fluidly connected will provide softer cushioning.

Each of the second domed pods 36 of the stacked domed pod pairs 50 in the medial row are directly fluidly connected only to an adjacent one of annular ring pods 38 of the stacked annular ring pod/domed pod pairs 64 by a connecting channel 74. Each of the second domed pods 36 of the stacked domed pod pairs 50 in the lateral row are directly fluidly connected only to an adjacent one of annular ring pods 38 of the stacked annular ring pod/domed pod pairs 64 by a connecting channel 74. None of the second domed pods 36 in the medial row are directly fluidly connected to one another, and none of the second domed pods 36 in the lateral row are directly fluidly connected to one another. Each of the annular ring pods 38 of the stacked annular ring pod/domed pod pairs 64 are directly fluidly connected to an adjacent one of the annular ring pods 38 of the stacked annular ring pod/domed pod pairs 64 by a connecting channel 74. A rearmost one of the annular ring pods 38 is directly fluidly connected to two of the second domed pods 36 in the lateral row and to two of the second domed pods 36 in the medial row.

The second sealed chamber 34 thus fluidly interconnects the annular ring pods 38 with one another and with the second domed pods 36. If internal volumes of the annular ring pods 38 are less than internal volumes of the second domed pods 36, the smaller volume will cause the annular ring pods 38 to provide quicker energy return and associated responsive underfoot feel under dynamic loading than the larger volume second domed pods 36, as maximum displacement is more quickly reached in the annular ring pods 38 than in the larger volume second domed pods 36, which provide a softer underfoot feel.

By fluidly interconnecting the first domed pods 32 with one another, and by fluidly interconnecting the annular ring pods 38 and the second domed pods 36, a compressive force applied to one region of the bladder system 14 can affect pressure in the other regions. For example, a compressive force in the heel region 20 can displace some of the gas from the domed pods 32, 36 or annular ring pods 38 in the heel region 20 to domed pods 32, 36, or annular ring pods 38 forward of the heel region 20 via the interconnected pods of the first sealed chamber 30, and via the interconnected pods of the second sealed chambers 34. This effectively preloads the pods forward of the heel region 20 to provide a stiffer response upon compression of those forward pods during forward foot roll.

As shown in FIG. 4, each of the second domed pods 36 in the medial row includes a peripheral flange 59 where the third sheet 58 is bonded to the fourth sheet 60. Only some of the peripheral flanges 59 are labelled in FIG. 4. Some adjacent ones of the second domed pods 36 of the stacked domed pod pairs 50 in the medial row are connected with one another by their peripheral flanges 59 at the medial side 22. However, the fourth and fifth of the second domed pods 36 in the medial row are not connected by their peripheral flanges 59, providing a gap that continues inward to the annular ring pods 38, and is above the gap provided by the underlying disconnected ones of the first domed pods 32, further enhancing flexibility of the bladder system 14.

Each of the second domed pods 36 in the lateral row is also surrounded by the peripheral flange 59. Some of the second domed pods 36 of the stacked domed pod pairs 50 in the lateral row are connected to and integral with the peripheral flange 59 of an adjacent one of the second domed pods 36 in the lateral row, but the fourth and fifth of the second domed pods 36 in the lateral row are not connected with either adjacent pod 36 by their flanges 59, providing gaps that continue inward to the annular ring pods 38, and are above the gaps provided by the underlying disconnected ones of the first domed pods 32 of the lateral row, further enhancing flexibility of the bladder system 14.

FIG. 5 is taken at the cross-section shown in FIG. 4 in order to show the stacked nature of the first and second bladders 26, 28, including the annular ring pod/domed pod pair 64 between domed pod pairs 50 on the medial and lateral sides 22, 24. The ground-facing surface 40 at the pods 32 of the first subset 32A is shown resting directly on a ground plane G, but there may be other midsole layers and one or more outsole components between the first sheet 54 and the ground plane G in the sole structure 10. Without dynamic compressive loading, the first domed pods 32 of the second subset 32B may be above the ground plane G. A foot (not shown) would rest above or on the foot-facing surface 42 and be supported directly or indirectly by the bladder system 14.

The bond 80 of the second sheet 56 to the third sheet 58 connects the downwardly-extending lower portion of the annular ring pod 38 to the upwardly extending upper portion of the first domed pod 32 of the second subset 32B that underlies the annular ring pod 38. Between the annular void 34A (also referred to as annulus 34A) of the second sealed chamber 34 within the annular ring pod 38, the fourth sheet 60 is bonded to the third sheet 58 at a bond 82 that provides the circular or oval shape inward of each annulus 34A of the annular ring pods 38 in FIG. 4. It is apparent from FIG. 4 and FIG. 5 that the internal volume of each of the annular ring pods 38 is less than an internal volume of each of the second domed pods 36.

Stiffness of a cushioning layer is indicated by a plot of force versus displacement under dynamic loading, with stiffness being the ratio of change in compressive load (e.g., force in Newtons) to displacement of the cushioning layer (e.g., displacement in millimeters along the axis of the compressive load). The compressive stiffness of different portions of the bladder system 14 would be dependent in part upon the relative inflation pressures of the first sealed chamber 30 and the second sealed chamber 34. The overall volume of the first sealed chamber 30 is greater than the overall volume of the second sealed chamber 34, as it is configured with stacked domed pod pairs 50 each having a first domed pod 32 and a second domed pod 36 of substantially equal internal volume, and having the same number of connecting channels 62 and 74, but having stacked annular ring pod/domed pod pairs 64 in which the annular ring pod 38 is of a smaller internal volume than the underlying first domed pod 32 (of the second subset 32B). Assuming the four stacked sheets 54, 56, 58, and 60 are of the same material or materials and construction, and are of equal thickness, if the inflation pressures of the first sealed chamber 30 and the second sealed chamber 34 are the same, then the first domed pods 32 should experience greater initial displacement under dynamic loading than the second domed pods 36 and the annular ring pods 38, providing an initial stage of relatively low stiffness, followed by a subsequent stage of greater stiffness after the first domed pods 32 reach their maximum compression. The second domed pods 36 should provide a steeper ramp in stiffness on a load versus displacement curve than the first domed pods 32 as they cannot displace gas as readily to the lower volume annular ring pod 38 as the first domed pods 32 can displace to one another. The annular ring pod 38 may provide the most rapid increase in stiffness at the portions of the foot that they underlie.

Additionally, as the entire first sealed chamber 30 is in fluid communication from the heel region 20 to the forefoot region 16, and the entire second sealed chamber 34 is likewise in fluid communication from the heel region 20 to the forefoot region 16, preloading of the midfoot region 18 and the forefoot region 16 may occur as the foot compresses the bladder system 14 with an initial heel strike and a roll forward, increasing the stiffness of the midfoot region 18, and then of the forefoot region 16 during the forward roll. This may beneficially provide a relatively stiff, supportive platform for toe off. Stated differently, a fast-loading, energy efficient stiffness in the forefoot region 16 greater than the stiffness in the heel region 20 and midfoot region 18 is appropriate for toe-off. Additionally, some of the first domed pods 32 and second domed pods 36 in the forefoot region 16 are smaller (with smaller internal volumes) than at least some of those in the midfoot region 18 and heel region 20, and the annular ring pod 38 at the foremost portion of the forefoot region 38 has a smaller internal volume than at least some of those more rearward.

FIG. 5 also illustrates that the bond 52 connecting the second sheet 56 to the third sheet 58 at one or more of the stacked domed pod pairs 50 may be an off-center bond. The off-center bond 52 couples the domed upper surface 44 of a first domed pod 32 to the domed lower surface 46 of a second domed pod 36. The off-center bond 52 is offset from both of or at least not centered at either of the center axis A1 of the first domed pod 32 and the center axis A2 of the second domed pod 36 that it connects. The bond 52 is off-center toward an interior of the bladder system 14 (e.g., further toward the interior and away from the exterior than would be a bond 52 at the center axis A1, A2). With an off-center bond 52, more surface area of the second and third sheets 56, 58 forming the domed pods 32, 36 will be exposed on one side (the exterior side, near the outer perimeter 63) of the off-center bond 52 than on the other side (the interior side) of the off-center bond 52. If the off-center bond is on a stacked domed pod pair 50 disposed at the outer perimeter 63 and is nearer to an interior side of a stacked domed pod pair 50 than to the outer perimeter 63 of the bladder system 14, then more surface area of the second and third sheets 56, 58 of the connected domed pods 32, 36 will be exposed at the outer perimeter 63 than with a centered bond. This will provide more surface area for bonding other components of the footwear to the bladder system 14 at the outer perimeter 63, if desired, such as a footwear upper.

Figure 6:
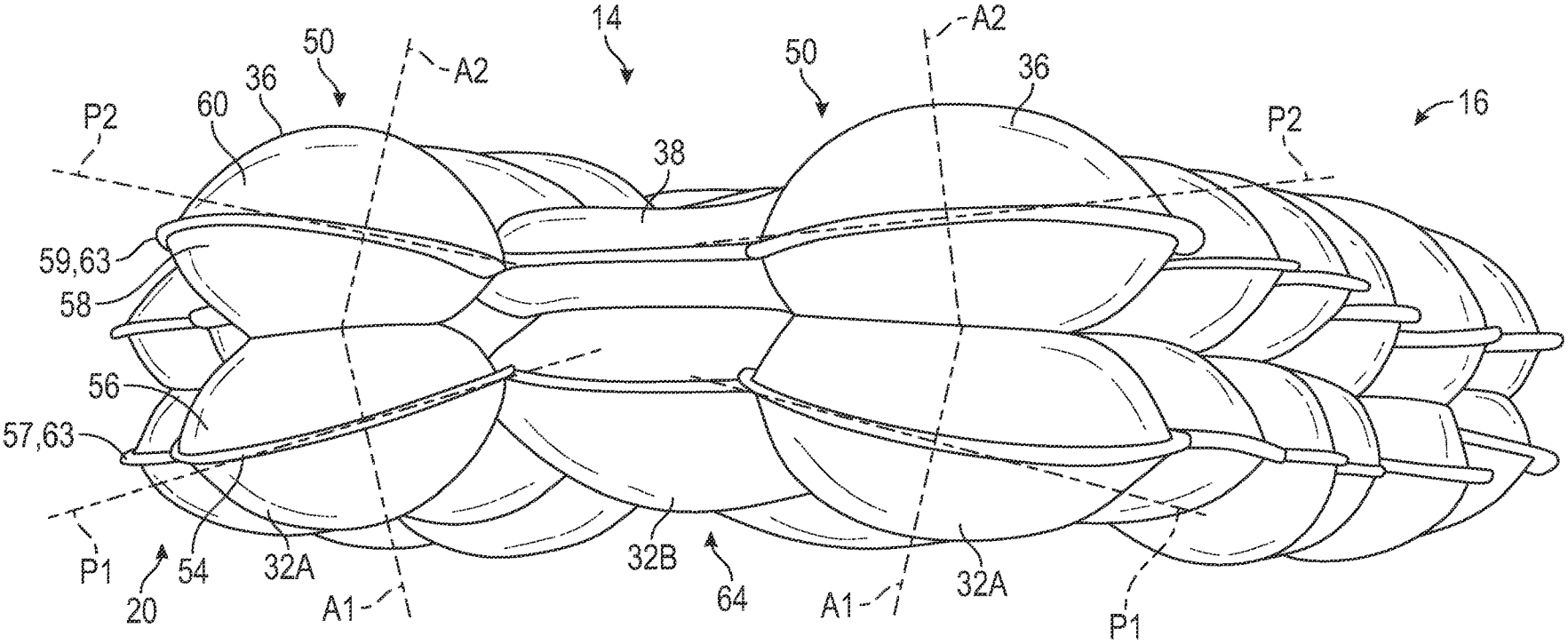
FIG. 6 is a rear perspective view of the bladder system of FIG. 1.

Additionally, an off-center bond 52 between the two domed pods 32, 36 may cause the inflated domed pods 32, 36 to splay further apart from one another in a direction away from the off-center bond 52 in comparison to a domed pod pair having a centered bond. For example, as best shown in FIG. 6, a plane P1 through the first domed pod 32 and perpendicular to the center axis A1 will diverge at the exterior side of the bladder system 14 from a plane P2 through the second pod 32 and perpendicular to the second center axis A2. The planes P1 and P2 are perpendicular to the plane of the page in FIG. 5. When the off-center bond 52 is closer to an interior side than an exterior side of the domed pod pair 50 as in FIG. 6, and the domed pod pair 50 is disposed at the outer perimeter 63 of the bladder system 14, more of the exposed surface area of the middle sheets (the second and third polymeric sheets 56, 58) at the outer perimeter of the domed pod pair 50 will face outward, providing a larger area for attachment of other footwear components, such as a footwear upper. Stated differently, an angle approximating the separation between the flanges 57, 59 of the domed pods 32, 36 of a domed pod pair 50 will be greater at the exterior side than the interior side. The exterior side of the domed pod pair 50 may also have a greater stacked height than the interior side when an off-center bond 52 is used, as shown in FIG. 6. In one example, at least one of the stacked domed pod pairs 50 including the off-center bond 52 is in the heel region 20 of the bladder system 14.

The following Clauses provide example configurations of an article of footwear disclosed herein.

Clause 1: A sole structure for an article of footwear comprising: a midsole including a bladder system comprising a first bladder enclosing a first sealed chamber retaining fluid as a first cushioning layer, and a second bladder enclosing a second sealed chamber isolated from the first sealed chamber and retaining fluid as a second cushioning layer; the second bladder overlying the first bladder and having a lower surface bonded to an upper surface of the first bladder, the first bladder establishing a ground-facing surface of the bladder system and the second bladder establishing a foot-facing surface of the bladder system; the first bladder comprising first domed pods extending at the ground-facing surface and at an upper surface of the first bladder, the first sealed chamber filling the first domed pods; and the second bladder comprising second domed pods and annular ring pods, the second domed pods and the annular ring pods extending at a lower surface of the second bladder and at the foot-facing surface, the second sealed chamber filling the second domed pods and the annular ring pods.

Clause 2: The sole structure of Clause 1, wherein the bladder system comprises four stacked polymeric sheets, the four stacked polymeric sheets including: a first sheet establishing the ground-facing surface and including lower portions of the first domed pods; a second sheet overlying and bonded to the first sheet to enclose the first sealed chamber, the second sheet establishing the upper surface of the first bladder and including upper portions of the first domed pods; a third sheet overlying and bonded to the second sheet, the third sheet establishing the lower surface of the second bladder and including lower portions of the second domed pods and lower portions of the annular ring pods; and a fourth sheet overlying and bonded to the third sheet to enclose the second sealed chamber and establishing the foot-facing surface, the fourth sheet including upper portions of the second domed pods and upper portions of the annular ring pods.

Clause 3: The sole structure of any of Clauses 1-2, wherein: the first sealed chamber fluidly interconnects the first domed pods with one another; and the second sealed chamber fluidly interconnects the annular ring pods with one another and with the second domed pods.

Clause 4: The sole structure of any of Clauses 1-3, wherein an internal volume of each of the annular ring pods is less than an internal volume of each of the second domed pods.

Clause 5: The sole structure of any of Clauses 1-4, wherein: each of the second domed pods overlies and is bonded to a different one of the first domed pods, establishing stacked domed pod pairs.

Clause 6: The sole structure of Clause 5, wherein: at least some of the first domed pods have different internal volumes; and each of the stacked domed pod pairs includes one of the first domed pods and one of the second domed pods having equal internal volumes.

Clause 7: The sole structure of Clause 5, wherein each of the annular ring pods overlies and is bonded to a different one of the first domed pods not bonded to any of the second domed pods, establishing stacked annular ring pod/domed pod pairs.

Clause 8: The sole structure of Clause 7, wherein the stacked annular ring pod/domed pod pairs are arranged in a row extend longitudinally along the bladder system.

Clause 9: The sole structure of Clause 8, wherein the stacked domed pod pairs are arranged in a medial row at a medial side of the bladder system, and in a lateral row at a lateral side of the bladder system, the row of the stacked annular ring pod/domed pod pairs is disposed between the medial row of stacked domed pod pairs and the lateral row of stacked domed pod pairs.

Clause 10: The sole structure of Clause 9, wherein: each of the first domed pods of the stacked domed pod pairs in the medial row is directly fluidly connected only to an adjacent one of first domed pods of the stacked annular ring pod/domed pod pairs; each of the first domed pods of the stacked domed pod pairs in the lateral row is directly fluidly connected only to an adjacent one of first domed pods of the stacked annular ring pod/domed pod pairs; and each of the first domed pods of the stacked annular ring pod/domed pod pairs is directly fluidly connected to an adjacent one of the first domed pods of the stacked annular ring pod/domed pod pairs.

Clause 11: The sole structure of Clause 9, wherein: none of the first domed pods of the stacked domed pod pairs in the medial row are directly fluidly connected to one another; and none of the first domed pods of the stacked domed pod pairs in the lateral row are directly fluidly connected to one another.

Clause 12: The sole structure of Clause 9, wherein a rearmost one of the first domed pods of the stacked annular ring pod/domed pod pairs is directly fluidly connected to two of the first domed pods of the stacked domed pod pairs in the lateral row and to two of the first domed pods of the stacked domed pod pairs in the medial row.

Clause 13: The sole structure of Clause 9, wherein: each of the second domed pods of the stacked domed pod pairs in the medial row is directly fluidly connected only to an adjacent one of annular ring pods of the stacked annular ring pod/domed pod pairs; each of the second domed pods of the stacked domed pod pairs in the lateral row is directly fluidly connected only to an adjacent one of annular ring pods of the stacked annular ring pod/domed pod pairs; and each of the annular ring pods of the stacked annular ring pod/domed pod pairs is directly fluidly connected to an adjacent one of the annular ring pods of the stacked annular ring pod/domed pod pairs.

Clause 14: The sole structure of Clause 9, wherein: none of the second domed pods of the stacked domed pod pairs in the medial row are directly fluidly connected to one another; and none of the second domed pods of the stacked domed pod pairs in the lateral row are directly fluidly connected to one another.

Clause 15: The sole structure of Clause 9, wherein a rearmost one of the annular ring pods of the stacked annular ring pod/domed pod pairs is directly fluidly connected to two of the second domed pods of the stacked domed pod pairs in the lateral row and to two of the second domed pods of the stacked domed pod pairs in the medial row.

Clause 16: The sole structure of Clause 9, wherein: each of the first domed pods of the stacked domed pod pairs in the medial row includes a peripheral flange, the peripheral flange of at least one of the first domed pods of the stacked domed pod pairs in the medial row is connected to and is integral with the peripheral flange of an adjacent one of the first domed pods of the stacked domed pod pairs in the medial row; and each of the first domed pods of the stacked domed pod pairs in the lateral row includes a peripheral flange, the peripheral flange of at least one of the first domed pods of the stacked domed pod pairs in the lateral row is connected to and is integral with the peripheral flange of an adjacent one of the first domed pods of the stacked domed pod pairs in the lateral row.

Clause 17: The sole structure of Clause 9, wherein: each of the second domed pods of the stacked domed pod pairs in the medial row includes a peripheral flange, the peripheral flange of at least one of the second domed pods of the stacked domed pod pairs in the medial row is connected to and is integral with the peripheral flange of an adjacent one of the second domed pods of the stacked domed pod pairs in the medial row; and each of the second domed pods of the stacked domed pod pairs in the lateral row includes a peripheral flange, the peripheral flange of at least one of the second domed pods of the stacked domed pod pairs in the lateral row is connected to and is integral with the peripheral flange of an adjacent one of the second domed pods of the stacked domed pod pairs in the lateral row.

Clause 18: The sole structure of Clause 7, wherein the stacked domed pod pairs at least partially establish an outer perimeter of the bladder system.

Clause 19: The sole structure of Clause 18, wherein at least one of the stacked domed pod pairs includes an off-center bond coupling a domed upper surface of a first domed pod to a domed lower surface of a second domed pod, and the off-center bond is nearer to an interior side of the at least one of the stacked domed pod pairs than to the outer perimeter of the bladder system.

Clause 20: The sole structure of Clause 19, wherein the at least one of the stacked domed pod pairs including the off-center bond is in a heel region of the bladder system.

Clause 21: The sole structure of any of Clauses 1-20, wherein: the first bladder defines through holes between at least some adjacent ones of the first domed pods; and the second bladder defines through holes between at least some of the second domed pods and the annular ring pods.

Clause 22: A sole structure comprising: a midsole including a bladder system comprising four stacked polymeric sheets, the four stacked polymeric sheets including: a first sheet establishing a ground-facing surface of the bladder system, a second sheet overlying and bonded to the first sheet to enclose a first sealed chamber retaining fluid as a first cushioning layer, a third sheet overlying and bonded to the second sheet, and a fourth sheet overlying and bonded to the third sheet to enclose a second sealed chamber isolated from the first sealed chamber and retaining fluid as a second cushioning layer, the fourth sheet establishing a foot-facing surface of the bladder system; wherein the first sheet and the second sheet comprise first domed pods extending at the ground-facing surface of the first sheet and at an upper surface of the second sheet, the first sealed chamber filling the first domed pods; wherein the third sheet and the fourth sheet comprise both second domed pods and annular ring pods; wherein the second domed pods extend downward at the third sheet and are bonded to the second sheet at a first subset of the first domed pods, establishing stacked domed pod pairs, and extend upward at the foot-facing surface of the fourth sheet; and wherein the annular ring pods extend downward at the third sheet and are bonded to the second sheet at a second subset of the first domed pods, establishing stacked annular ring pod/domed pod pairs, and extend upward at the foot-facing surface of the fourth sheet, the second sealed chamber filling the second domed pods and the annular ring pods.

Clause 23: The sole structure of Clause 22, wherein the stacked annular ring pod/domed pod pairs are arranged in a row extend longitudinally along the bladder system.

Clause 24: The sole structure of Clause 23, wherein the stacked domed pod pairs are arranged in a medial row at a medial side of the bladder system, and in a lateral row at a lateral side of the bladder system, and the row of the stacked annular ring pod/domed pod pairs is disposed between the medial row of stacked domed pod pairs and the lateral row of stacked domed pod pairs.

Clause 25: The sole structure of Clause 24, wherein: each of the first domed pods of the stacked domed pod pairs in the medial row is directly fluidly connected only to an adjacent one of first domed pods of the stacked annular ring pod/domed pod pairs; each of the first domed pods of the stacked domed pod pairs in the lateral row is directly fluidly connected only to an adjacent one of first domed pods of the stacked annular ring pod/domed pod pairs; and each of the first domed pods of the stacked annular ring pod/domed pod pairs is directly fluidly connected to an adjacent one of the first domed pods of the stacked annular ring pod/domed pod pairs.

Clause 26: The sole structure of Clause 24, wherein: none of the first domed pods of the stacked domed pod pairs in the medial row are directly fluidly connected to one another; and none of the first domed pods of the stacked domed pod pairs in the lateral row are directly fluidly connected to one another.

Clause 27: The sole structure of Clause 22, wherein: the stacked domed pod pairs are disposed at an outer perimeter of the bladder system; and at least one of the stacked domed pod pairs includes an off-center bond coupling a domed upper surface of one of the first domed pods to a domed lower surface of one of the second domed pods, and the off-center bond is nearer to an interior side of the at least one of the stacked domed pod pairs than to the outer perimeter of the bladder system.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A sole structure for an article of footwear comprising:

a midsole including a bladder system comprising a first bladder enclosing a first sealed chamber retaining fluid as a first cushioning layer, and a second bladder enclosing a second sealed chamber isolated from the first sealed chamber and retaining fluid as a second cushioning layer;

the first bladder establishing a ground-facing surface of the bladder system and the second bladder establishing a foot-facing surface of the bladder system;

the first bladder comprising first domed pods extending at the ground-facing surface and at an upper surface of the first bladder, the first sealed chamber filling the first domed pods;

the second bladder comprising second domed pods extending at a lower surface of the second bladder and at the foot-facing surface, the second sealed chamber filling the second domed pods;

wherein the second domed pods overlie and are bonded to the first domed pods, establishing stacked domed pod pairs at an outer perimeter of the bladder system;

wherein at least one of the stacked domed pod pairs includes a respective off-center bond coupling a domed upper surface of a first domed pod to a domed lower surface of a second domed pod, the respective off-center bond being nearer to an interior side of the at least one of the stacked domed pod pairs than to the outer perimeter of the bladder system; and wherein a plane through the first domed pod of the at least one of the stacked domed pod pairs including the respective off-center bond and perpendicular to a center axis of the first domed pod of the at least one of the stacked domed pod pairs including the respective off-center bond diverges at an exterior side of the bladder system from a plane through the second domed pod of the at least one of the stacked domed pod pairs including the respective off-center bond and perpendicular to a second center axis of the second pod of the at least one of the stacked domed pod pairs including the respective off-center bond.

2. The sole structure of claim 1, wherein the respective off-center bond terminates inward of the first center axis of the first domed pod and the second center axis of the second domed pod of the at least one of the stacked domed pod pairs.

3. The sole structure of claim 1, wherein the at least one of the stacked domed pod pairs including the respective off-center bond is in a heel region of the bladder system.

4. The sole structure of claim 1, wherein the bladder system comprises four stacked polymeric sheets, the four stacked polymeric sheets including:

a first sheet establishing the ground-facing surface and including lower portions of the first domed pods;

a second sheet overlying and bonded to the first sheet to enclose the first sealed chamber, the second sheet establishing the upper surface of the first bladder and including upper portions of the first domed pods;

a third sheet overlying and bonded to the second sheet, the third sheet establishing the lower surface of the second bladder and including lower portions of the second domed pods; and a fourth sheet overlying and bonded to the third sheet to enclose the second sealed chamber and establishing the foot-facing surface, the fourth sheet including upper portions of the second domed pods protruding upward at the foot-facing surface.

5. The sole structure of claim 1, wherein:

the first sealed chamber fluidly interconnects the first domed pods with one another; and the second sealed chamber fluidly interconnects the second domed pods with one another.

6. The sole structure of claim 1, wherein an exterior side of the at least one of the stacked domed pod pairs including the respective off-center bond has a greater stacked height than the interior side.

7. The sole structure of claim 1, wherein the stacked domed pod pairs are arranged in a medial row at a medial side of the bladder system, and in a lateral row at a lateral side of the bladder system.

8. The sole structure of claim 7, wherein none of the first domed pods of the stacked domed pod pairs in the medial row are directly fluidly connected to one another.

9. The sole structure of claim 7, wherein none of the first domed pods of the stacked domed pod pairs in the lateral row are directly fluidly connected to one another.

10. The sole structure of claim 7, wherein: each of the stacked domed pod pairs in the medial row includes a respective off-center bond coupling a domed upper surface of a first domed pod to a domed lower surface of a second domed pod, the respective off-center bond being nearer to the interior side of a corresponding one of the stacked domed pod pairs than to the outer perimeter of the bladder system.

11. The sole structure of claim 7, wherein: each of the stacked domed pod pairs in the lateral row includes a respective off-center bond coupling a domed upper surface of a first domed pod to a domed lower surface of a second domed pod, the respective off-center bond being nearer to the interior side of a corresponding one of the stacked domed pod pairs than to the outer perimeter of the bladder system.

12. The sole structure of claim 1, wherein the second bladder further comprises annular ring pods extending at the lower surface of the second bladder and at the foot-facing surface, the second sealed chamber further filling the annular ring pods.

13. The sole structure of claim 12, wherein each of the annular ring pods overlies and is bonded to a different one of the first domed pods not bonded to any of the second domed pods, establishing stacked annular ring pod/domed pod pairs.

14. The sole structure of claim 13, wherein:

the stacked annular ring pod/domed pod pairs are arranged in a row extending longitudinally along the bladder system;

the stacked domed pod pairs are arranged in a medial row at a medial side of the bladder system, and in a lateral row at a lateral side of the bladder system; and the row of the stacked annular ring pod/domed pod pairs is disposed between the medial row of stacked domed pod pairs and the lateral row of stacked domed pod pairs.

15. The sole structure of claim 14, wherein:

each of the first domed pods of the stacked domed pod pairs in the medial row is directly fluidly connected only to an adjacent one of first domed pods of the stacked annular ring pod/domed pod pairs;

each of the first domed pods of the stacked domed pod pairs in the lateral row is directly fluidly connected only to an adjacent one of first domed pods of the stacked annular ring pod/domed pod pairs; and each of the first domed pods of the stacked annular ring pod/domed pod pairs is directly fluidly connected to an adjacent one of the first domed pods of the stacked annular ring pod/domed pod pairs.

16. The sole structure of claim 14, wherein a rearmost one of the first domed pods of the stacked annular ring pod/domed pod pairs is directly fluidly connected to two of the first domed pods of the stacked domed pod pairs in the lateral row and to two of the first domed pods of the stacked domed pod pairs in the medial row.

17. The sole structure of claim 14, wherein:

each of the second domed pods of the stacked domed pod pairs in the medial row is directly fluidly connected only to an adjacent one of annular ring pods of the stacked annular ring pod/domed pod pairs;

each of the second domed pods of the stacked domed pod pairs in the lateral row is directly fluidly connected only to an adjacent one of annular ring pods of the stacked annular ring pod/domed pod pairs; and each of the annular ring pods of the stacked annular ring pod/domed pod pairs is directly fluidly connected to an adjacent one of the annular ring pods of the stacked annular ring pod/domed pod pairs.

18. The sole structure of claim 14, wherein a rearmost one of the annular ring pods of the stacked annular ring pod/domed pod pairs is directly fluidly connected to two of the second domed pods of the stacked domed pod pairs in the lateral row and to two of the second domed pods of the stacked domed pod pairs in the medial row.

19. The sole structure of claim 14, wherein the second bladder defines through holes between at least some of the second domed pods and the annular ring pods.

* * * * *